United States Patent [19]

Kiritani et al.

[11] Patent Number: 4,746,644

[45] Date of Patent: May 24, 1988

[54] RECORDING MATERIAL

[75] Inventors: Masataka Kiritani; Toshiharu Tanaka; Toshimasa Usami, all of Shizuoka, Japan

[73] Assignee: Fuji Photo Film Co., Ltd., Kanagawa, Japan

[21] Appl. No.: 785,689

[22] Filed: Oct. 9, 1985

[30] Foreign Application Priority Data

Oct. 9, 1984 [JP] Japan ..... 59-212246

[51] Int. Cl.[4] ..... B41M 5/16; B41M 5/18; B41M 5/22

[52] U.S. Cl. ..... 503/209; 427/150; 428/913; 428/914; 503/213; 503/215; 503/221; 503/224

[58] Field of Search ..... 346/209, 208, 213, 215; 427/150–152; 503/208, 209, 213, 215, 221, 224

[56] References Cited

U.S. PATENT DOCUMENTS 4,489,336 12/1984 Aoyagi et al. ..... 346/209
4,620,941 11/1986 Yoshikawa et al. ..... 548/152

FOREIGN PATENT DOCUMENTS 0148587 11/1981 Japan ..... 346/209
0025989 2/1983 Japan ..... 346/209
1429640 3/1976 United Kingdom ..... 346/209

*Primary Examiner*—Bruce H. Hess
*Attorney, Agent, or Firm*—Sughrue, Mion, Zinn, Macpeak, and Seas

[57] ABSTRACT

A recording material comprising a support having provided thereon, microcapsules containing a basic leuco dye dissolved in an organic solvent is disclosed. The microcapsules further contains at least one compound selected from the group consisting of 2-mercaptobenzothiazoles, guanidines, thioureas, 2-mercaptoimidazolines and thiurams. The recording material is free from coloration due to exposure to light and provides a recorded image of high density and high contrast.

9 Claims, No Drawings

RECORDING MATERIAL

FIELD OF THE INVENTION

This invention relates to a recording material and, more particularly, to a recording material comprising a support having provided thereon microcapsules containing a basic leuco dye, such as a pressure-sensitive recording sheet and heat-sensitive recording sheet.

BACKGROUND OF THE INVENTION

Pressure-sensitive recording sheets include a system comprising an upper paper having coated thereon a microcapsule layer containing microcapsules produced by encapsulation of oil droplets of substantially colorless basic leuco dyes dissolved in an appropriate solvent and a lower paper having coated thereon an electron-accepting layer (hereinafter referred to as a "developer layer") containing an electron-accepting compound (hereinafter referred to as a "developer") and, if desired, an intermediate paper having coated on one side thereof a microcapsule layer and on another side thereof a developer layer; a monosheet type comprising a support containing on one side thereof the aforesaid microcapsules and developer; and a sheet comprising a support having contained therein on one of the aforesaid microcapsules and developer and having coated thereon the another.

These pressure-sensitive recording papers are disclosed, e.g. in U.S. Pat. Nos. 2,505,470, 2,505,489, 2,550,471, 2,730,457 and 3,418,250 and Japanese Patent Publication No. 49509/73 (corresponding to British Pat. No. 1,396,543).

Heat-sensitive recording sheets using microcapsules are taught in, e.g., Japanese Patent Application No. 99490/84 (corresponding to U.S. patent Ser. No. 735,227 filed on May 17, 1985 and British Application No. 8512303 filed on May 15, 1985). These heat-sensitive recording sheets comprise a support having provided on the same side thereof microcapsules containing a solution of a color former in an organic solvent and a developer capable of reacting with the color former to develop a color. Upon heating, the microcapsule walls become permeable to cause a reaction between the color former and the developer so as to obtain an image. Color formers widely employed are basic leuco dyes, and the developers usable include phenol compounds, organic acids and their metal salts, hydroxybenzoic acid esters, and the like.

The walls of the microcapsules used in the heat-sensitive recording sheet should allow permeation of at least one of the color former and the developer upon application of heat. Examples of high polymeric substances that constitute such capsule walls include polyurethane, polyurea, polyamide, polyester, polycarbonate, urea-formaldehyde resin, melamine resin, polystyrene, styrenemethacrylate copolymer, styrene-acrylate copolymer, and the like.

The microcapsules can advantageously be prepared through polymerization of the reactants which are supplied from the inside of oil droplets. According to this process, capsules that have a uniform size distribution and are suitable for recording materials excellent in preservability can be obtained in a short time.

The above-described encapsulation process and specific examples of compounds used therefor are described in U.S. Pat. Nos. 3,726,804 and 3,796,669.

However, recording sheets having coated thereon these microcapsules containing a solution of a basic leuco dye undergo coloration on their entire surface when exposed to light for a long period of time.

Further, the colored recording sheets have a reduced color-forming property and only provide a low density recorded image. Such a phenomenon scarcely takes place when the basic leuco dye is used as a dispersed solid, but is significant in the cases when the basic leuco dye is dissolved in an organic solvent.

For the purpose of improving the light-fastness of a developed dye image on the lower paper in the pressure-sensitive recording sheet, it is known to incorporate an ultraviolet adsorbent into the microcapsules together with the basic leuco dye solution as disclosed in Japanese Patent Publication No. 14380/69. However, the use of only the ultraviolet adsorbent is insufficient in complete prevention of coloration of the microcapsule sheet.

SUMMARY OF THE INVENTION

An object of this invention is to provide a recording material carrying microcapsules containing an organic solvent solution of a basic leuco dye, which is free from coloration due to light.

Another object of this invention is to provide a recording material which can provide an image having a high color density and high contrast.

As a result of extensive investigations, it has now been found that the above-described problem can be solved by incorporating at least one compound selected from the group consisting of 2-mercaptobenzothiazoles, guanidines, thioureas, 2-mercaptoimidazolines and thiurams in an organic solvent solution of a basic leuco dye in microcapsules.

DETAILED DESCRIPTION OF THE INVENTION

The 2-mercaptobenzothiazoles which can be incorporated in microcapsules together with a basic leuco dye include N-cyclohexyl-2-benzothiazolylsulfeneamide, a cyclohexylamine salt of 2-mercaptobenzothiazole, 2-(4'-morpholinodithio)benzothiazole, N-hydroxydiethylene-2-benzothiazolylsulfeneamide, N-t-butyl-2-benzothiazolylsulfeneamide, dibenzothiazyl disulfide, 2-mercaptobenzothiazole, and the like.

The guanidines which can be used in the present invention include 1,3-diphenylguanidine, diorthotolylguanidine, 1-ortho-tolylbiguanide, etc.

The thioureas which can be used in the present invention include N,N'-diphenylthiourea, N,N'-diethylthiourea, dibutylthiourea, dilaurylthiourea, etc.

Examples of the 2-mercaptoimidazolines to be used include 2-mercapto-2-imidazoline.

Examples of the thiurams to be used are tetramethylthiuram disulfide, tetraethylthiuram disulfide, tetrabutylthiuram disulfide, tetramethylthiuram monosulfide, etc.

Among the aforesaid groups of compounds, 2-mercaptobenzothiazoles and thiurams produce a particularly great effect, more preferably 2-mercaptobenzothiazoles. The most effective one is N-cyclohexyl-2-benzothiazolylsulfeneamide.

These compounds of the present invention are used in a total amount of from 0.02 to 10% by weight, preferably from 0.2 to 8% by weight, and more preferably from 0.4 to 4% by weight, based on the organic solvent.

It is preferable to use an ultraviolet absorbent in combination with the above-mentioned compounds according to the present invention. Such a combined use of an ultraviolet absorbent and the compound of the present invention brings about a synergistically increased stability that can never be achieved with either one of the ultraviolet absorbent or the compound of this invention alone.

The ultraviolet adsorbents that can preferably be used in the present invention are those having spectral absorption at wavelengths of from 270 to 380 mμ, such as salicyclic acid type ultraviolet absorbents, e.g., phenyl salicylate, p-t-butylphenyl salicylate, p-octylphenyl salicylate, etc.; benzophenone type ultraviolet absorbents, e.g., 2,4-dihydroxybenzophenone, 2-hydroxy-4-methoxybenzophenone, 2-hydroxy-4-octoxybenzophenone, 2-hydroxy-4-dodecyloxybenzophenone, 2,2'-dihydroxy-4-methoxybenzophenone, 2,2'-dihydroxy-4,4'-dimethoxybenzophenone, 2-hydroxy-4-methoxy-5-sulfobenzophenone, etc.; benzotriazole type ultraviolet absorbents, e.g., 2(2'-hydroxy-5'-methylphenyl)benzotriazole, 2(2'-hydroxy-5'-t-butylphenyl)benzotriazole, 2(2'-hydroxy-3',5'-di-t-butylphenyl)benzotriazole, 2(2'-hydroxy-3'-t-butyl-5'-methylphenyl)-5-chlorobenzotriazole, 2(2'-hydroxy-3',5'-di-t-butylphenyl)-5-chlorobenzotriazole, 2(2'-hydroxy-3',5'-di-t-amylphenyl)benzotriazole, 2(2'-hydroxy-4'-octoxyphenyl)-benzotriazole, etc.; cyanocrylate type ultraviolet absorbents, e,g., 2-ethylhexyl-2-cyano-3,3'-diphenylacrylate, ethyl-2-cyano-3,3'-diphenylacrylate, etc.; and the like. The preferred among them are benzotriazole type compounds, with 2(2'-hydroxy-5'-methylphenyl)benzotriazole being particularly preferred.

The ultraviolet absorbent is used in an amount of from 0.01 to 10.0% by weight, preferably from 0.2 to 5.0% by weight, and more preferably from 0.4 to 4% by weight, based on the organic solvent.

Specific examples of the basic leuco dyes which can be used in the present invention include (1) triarylmethane type compounds, e.g., 3,3-bis(p-dimethylaminophenyl)-6-dimethylaminophthalide (Crystal Violet Lactone), 3,3-bis(p-dimethylaminophenyl)phthalide, 3-(p-dimethylaminophenyl)-3-(1,2-dimethylindol-3-yl)phthalide, 3-(p-dimethylaminophenyl)3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.; (2) dimethylmethane type compounds, e.g., 4,4'-bis-dimethylaminobenzhydrinbenzyl ether, an N-halophenyl leucoauramin, N-2,4,5-trichlorophenyl leucoauramine, etc.; (3) xanthene type compounds, e.g., Rhodamine B-anilinolactam, Rhodamine B-p-nitroanilinolactam, Rhodamine B-p-chloroanilinolactam, 2-dimethylamino-7-methoxyfluoran, 2-diethylamino-7-methoxyfluoran, 3-diethylamino-7-methoxyfluoran, 3-diethylamino-7-methoxyfluoran, 3-diethylamino-7-chlorofluoran, 2-diethylamino-3-chloro-7-methylfluoran, 7-diethylamino-2,2-dimethylfluoran, 7-diethylamino-3-acetylmethylaminofluoran, 7-diethylamino-3-methylaminofluoran, 2-methyl-3-anilino-7-cyclohexyl-N-methylaminofluoran, 2-chloro-3-anilino-7-diethylaminofluoran, 3-diethylamino-6-methyl-7-anilinofluoran, 3,7-diethylaminofluoran, 3-diethylamino-7-dibenzylaminofluoran, 3-diethylamino-7-methylbenzylaminofluoran, 3-diethylamino-7-chloroethylmethylaminofluoran, 3-diethylamino-7-diethylaminofluoran, etc.; (4) thiazine type compounds, e.g., benzoyl Leucomethylene Blue, p-nitrobenzoyl Leucomethylene Blue, etc.; (5) spiro type compounds, e.g., 3-methyl-spiro-dinaphthopyran, 3-ethyl-spiro-dinaphthopyran, 3.3'-dichloro-spiro-dinaphthopyran, 3-benzyl-spiro-dinaphthopyran, 3-methyl-naphtho(3-methoxybenzo)-spiropyran), 3-propyl-spiro-dibenzopyran, etc.; and mixtures thereof. The kind of the leuco dye to be used can be determined depending on the end use or the desired characteristic. In particular, the effect of the present invention is conspicuous when the triarylmethane type leuco dyes and fluoran type leuco dyes having a phthalide structure are employed. The greatest effect can be exerted in terms of prevention of red coloration when using black series leuco dyes selected from fluoran compounds having an amino group or a substituted amino group at the 3- and 7-positions of the fluoran ring. These leuco dyes are suitably used in amounts ranging from 5° to 20° by weight based on the organic solvent.

The organic solvent which can be used for dissolving the above-described leuco dyes preferably has a boiling point of 180° C. or higher since low-boiling organic solvents undergo loss due to evaporation during preservation. Such organic solvents include phosphoric esters, phthalic esters, other carboxylic acid esters, fatty acid amides, alkylated biphenyls, alkylated terphenyls, chlorinated paraffin, alkylated naphthalenes, diarylethanes, and the like. Specific examples thereof are tricresyl phosphate, trioctyl phosphate, ocryldiphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, acetyltriethyl citrate, octyl maleate, dibutyl maleate, isopropylbiphenyl, isoamylbiphenyl, chlorinated paraffin, diisopropylnaphthalene, 1,1'-ditolylethane, 2,4-di-t-amylphenol, N,N-dibutyl-2-butoxy-5-t-octylaniline, etc. In addition, vinyl compounds may also be used as organic solvents.

The present invention covers in its scope not only pressure-sensitive recording sheets and heat-sensitive recording sheets but also any other recording materials comprising a support carrying microcapsules containing a basic leuco dye solution. The recording materials in which the present invention finds the most valuable application are recording sheets carrying microcapsules on their surfaces, such as heat-sensitive recording paper. When the present invention is applied to pressure-sensitive recording sheets, since the microcapsules are coated on the back surface, they are not directly exposed to light so that coloration does not readily occur. If any coloration may occur, it does not give rise to such a serious problem as encountered in the case of heat-sensitive recording sheets. When the present invention is applied to pressure-sensitive recording sheets, any microcapsules obtainable by usual encapsulation processes can be utilized.

For example, encapsulation processes, such as an interfacial polymerization process as disclosed in U.S. Pat. Nos. 3,429,827 and 3,577,515 and British Patents 1,091,077 and 1,091,078, etc., an internal polymerization process as disclosed in U.S. Pat. Nos. 2,969,330, 3,660,304, 3,726,804 and 3,796,669, an external polymerization process as disclosed in Japanese Patent Publication Nos. 14327/62, 12380/62 and 4717/73, etc., a corecelvation process as disclosed in U.S. Pat. Nos. 2,800,457, 2,730,456 and 2,712,507, etc., a process taking advantage of precipitation from a high polymer solution as disclosed in British Pat. No. 931,148 and U.S. Pat. No. 3,173,878, etc., and the like can be employed.

The microcapsules thus produced can be used for any of the upper paper, intermediate paper and monosheet type recording material, and are coated on a support in an amount of from 1 to 10 g/m$^2$, and preferably from 3 to 7 g/m$^2$, on a dry weight basis.

In the case where the microcapsules are used in heat-sensitive recording sheets, it is required that the microcapsule wall be impermeable at room temperature but become permeable upon application of heat. Specific examples of materials for such capsule walls include polyurethane, polyurea, polyamide, polyester, polycarbonate, urea-formaldehyde resins, melamine resins, polystyrene, styrene-methacrylate copolymers, styrene-acrylate copolymer, etc. Of these, those having a glass transition temperature of from 60° to 200° C. are preferred.

Encapsulation processes suitable for the production of heat-sensitive recording sheets are an internal polymerization process and an interfacial polymerization process.

In the heat-sensitive recording sheets, the microcapsules and the developer are provided on the same side of a support.

Examples of the developer for the above-mentioned dyes include phenol compounds, organic acids or metal salts thereof, and hydroxybenzoic acid esters.

Preferred developers are phenol compounds and organic acids which melt at about 50° to 250° C., preferably about 60° to 200° C., and are sparingly soluble in water.

Examples of phenol compounds include 4,4'-isopropylidene-diphenol (bisphenol A), p-tert-butylphenol, 2,4-dinitrophenol, 3,4-dichlorophenol, 4,4'-methylenebis(2,6-di-tert-butylphenol), p-phenylphenol, 4,4-cyclohexylidenediphenol, 2,2'-methylenebis(4-tert-butylphenol), 2,2'-methylenebis(α-phenyl-p-cresol)thiodiphenol, 4,4'-thiobis(6-tert-butyl-m-cresol), sulfonyldiphenol, 1,1-bis(4-hydroxyphenyl)-n-dodecane, 4,4-bis(4-hydroxyphenyl)-1-pentanoate, p-tert-butylphenol-formaldehyde condensate and p-phenylphenol-formaldehyde condensate.

Useful examples of organic acids and metal salts thereof include 3-tert-butylsalicylic acid, 3,5-tert-butylsalicylic acid, 5-α-methylbenzylsalicylic acid, 3,5-di-α-methylbenzylsalicylic acid, 3-tert-octylsalicylic acid, 5-α, γ-dimethyl-α-phenyl-γ-phenylpropylsalicylic acid and salts thereof of zinc, lead, aluminum, magnesium or nickel.

The hydroxybenzoic acid esters mentioned above include, among others, ethyl p-hydroxybenzoate, butyl p-hydroxybenzoate, heptyl p-hydroxybenzoate, and benzyl p-hydroxybenzoate. These compounds are used after being dispersed in solid state using a water-soluble polymer as protective colloid by means of a sand mill or the like.

The amount of the developer present per unit area (m$^2$) is in the range of from about 0.5 to 8 g, preferably from about 0.5 to 4 g.

The recording materials according to this invention may also contain conventional additives to ensure improved handling qualities before recording and improved printing qualities or to improve running properties for heat-sensitive recording materials, such as silica, barium sulfate, titanium oxide, aluminum hydroxide, zinc oxide, calcium carbonate and other pigments, polystyrene beads, comminuted urea-melamine resin, starch particles and cellulose powders. The level of addition of such additives is about 0.2 to 7 g/m$^2$.

The binders which can be used in the present invention include polyvinyl alcohol, methyl cellulose, carboxymethyl cellulose, hydroxypropyl cellulose, gum arabic, gelatin, polyvinylpyrrolidone, casein, styrene-butadiene copolymer latex, acrylonitrile-butadiene copolymer latex, polyvinyl acetate, polyacrylates, ethylene-vinyl acetate copolymer and various other polymer emulsions. The amount of such binders is about 0.5 to 5 g (as non-volatile matter)/m$^2$.

In the practice of the present invention, a parting agent or lubricant such as metal salts of fatty acid, wax, etc., a water resistance-imparting agent, dispersant, antifoamer, and the like can be employed in addition to the above-mentioned agents and additives.

Other additives which can be used in the present invention and the amounts thereof are also described in Japanese Patent Application No. 99490/84 (corresponding to U.S. patent Ser. No. 735,227 filed on May 17, 1985 and British Application No. 8512303 filed on May 15, 1985).

As for supports, base paper, coat paper having pigments provided thereon, synthetic resin, film and the like can be employed. The coating composition is applied on the support by a suitable technique such as bar coating, blade coating, air knife coating, gravure coating, roll coating, spray coating or dip coating to give a recording layer with a nonvolatile matter content of about 2.5 to 25 g/m$^2$.

The present invention will now be illustrated in greater detail with reference to the following examples, but it should be understood that the present invention is not limited thereto. In these examples, all parts and percents are by weight unless otherwise indicated.

EXAMPLE 1

In 24 parts of diisopropylnaphthalene were dissolved 2.4 parts of 2-methyl-3-anilino-7-cyclohexyl-N-methylaminofluoran and 2.4 parts of 2-chloro-3-anilino-7-diethylaminofluoran (basic leuco dyes), 1.4 parts of 2(2'-hydroxy-5'-methylphenyl)benzotriazole (ultraviolet absorbent) and 1.4 parts of N-cyclohexyl-2-benzothiazolylsulfeneamide (2-mercaptobenzothiazoles) to prepare a solution as a core. To the solution were added 18 parts of a 3:1 adduct of xylylene diisocyanate and trimethylolpropane and 17 parts of methylene chloride to form a solution. The resulting solution was mixed with an aqueous solution consisting of 3.5 parts of polyvinyl alcohol, 1.7 parts of gelatin, 2.4 parts of 1,4-di(hydroxyethoxy)benzene and 58 parts of water, and the mixture was emulsified and dispersed at 20° C. to obtain an emulsion having an average particle size of 3 μm. To the resulting emulsion was added 100 parts of water, and the mixture was heated to 60° C. while stirring. After 2 hours, there was obtained a capsule solution containing the leuco dye as a core substance.

Then, 20 parts of bisphenol A was dispersed in 100 parts of a 5% aqueous solution of polyvinyl alcohol in a sand mill for about 24 hours to obtain a dispersion of bisphenol A having an average particle size of 3 μm.

Five parts of the above prepared capsule solution and 3 parts of the bisphenol A dispersion were mixed to prepare a coating composition.

The coating composition was coated on a smooth fine paper having a basis weight of 50 g/m$^2$ to a dry weight of 7 g/m$^2$ and dried at 40° C. for 30 minutes to obtain a heat-sensitive recording material. The capsule had a glass transition temperature of 90° C.

EXAMPLE 2

A heat-sensitive recording material was produced in the same manner as described in Example 1 except that 2(2'-hydroxy-5'-methylphenyl)benzotriazole as an ultraviolet absorbent was not used and the amount of the N-cyclohexyl-2-benzothiazolylsulfeneamide was increased to 2.8 parts.

EXAMPLE 3

A heat-sensitive recording material was produced in the same manner as described in Example 1 except that the 2(2'-hydroxy-5'-methylphenyl)benzotriazole as an ultraviolet absorbent was not used.

COMPARATIVE EXAMPLE 1

A heat-sensitive recording material was produced in the same manner as described in Example 1 except that 2(2'-hydroxy-5'-methylphenyl)benzotriazole and N-cyclohexyl-2-benzothiazolylsulfeneamide were not used.

COMPARATIVE EXAMPLE 2

A heat-sensitive recording material was produced in the same manner as described in Example 1 except that N-cyclohexyl-2-benzothiazolylsulfeneamide was not used.

COMPARATIVE EXAMPLE 3

A heat-sensitive recording material was obtained in the same manner as described in Example 1 except that N-cyclohexyl-2-benzothiazolylsulfeneamide was not used and the amount of 2(2'-hydroxy-5-methylphenyl)-benzotriazole as an ultraviolet absorbent was increased to 2.8 parts.

When each of the above samples was used for recording by means of a GII mode heat-sensitive printer ("Panafax 200", a trade name manufactured by Matsushita Graphic Communication Systems, Inc.), a black recorded image was obtained.

Before recording, the recording layer (the coated surface) of each sample was irradiated with a high pressure mercury lamp for 2 minutes, and the color density was determined by measuring the magenta density using a Macbeth reflection densitometer. Further, the recording layer was exposed to indoor light for 2 days, and the color density was determined in the same manner as above. The results obtained are shown in Table 1 below.

TABLE 1

| Example No. | Color Density Before Irradiation | Color Density After Irradiation*1 | Color Density After Exposure*2 |
|---|---|---|---|
| Example 1 | 0.05 | 0.07 | 0.05 |
| Example 2 | 0.05 | 0.09 | 0.06 |
| Example 3 | 0.05 | 0.11 | 0.07 |
| Comparative Example 1 | 0.05 | 0.20 | 0.11 |
| Comparative Example 2 | 0.05 | 0.17 | 0.10 |
| Comparative Example 3 | 0.05 | 0.16 | 0.09 |

TABLE 1-continued

Note:
*1irradiation with a high pressure mercury lamp
*2exposure to indoor light From the results shown in Table 1 above, it can be seen that the recording materials (Examples 1 to 3) according to the present invention are very small in the undesired coloration after irradiation, but the recording materials including no the compounds of the present invention (Comparative Examples 1 to 3) remarkably undergo the undesired coloration after irradiation.

EXAMPLE 4

Five parts of a partial sodium salt of polyvinylbenzenesulfonic acid ("VERSA, TL 500", a trade name produced by National Starch Co., Ltd.; average molecular weight: 500,000) were added to 95 parts of hot water at about 80° C. while stirring. The stirring was continued for 30 minutes to form a solution, followed by cooling. The resulting aqueous solution had a pH of 2 to 3 and was then adjusted to a pH of 4.0 with a 20 wt% sodium hydroxide aqueous solution.

On the other hand, 100 parts of diisopropylnaphthalene having dissolved therein 2.5% of Crystal Violet lactone, 1.0% of benzoyl leucomethylene blue, 2% of N-cyclohexyl-2-benzothiazolylsulfeneamide and 2% of 2(2'-hydroxy-5'-methylphenyl)benzotriazole was emulsified and dispersed in 100 parts of the above-described 5% aqueous solution of the partial sodium salt of polyvinylbenzenesulfonic acid to obtain an emulsion having an average particle diameter of 4.5 μm. Separately, a mixture of 6 parts of melamine, 11 parts of a 37 wt% aqueous solution of formaldehyde and 30 parts of water was heated at 60° C. under stirring for 30 minutes to obtain a clear mixed aqueous solution containing melamine, formaldehyde and an initial condensate of melamine and formaldehyde. The mixed aqueous solution had a pH of 6 to 8. The above prepared mixed aqueous solution is hereinafter referred to as an initial condensate solution. The initial condensate solution was mixed with the above-mentioned emulsion with stirring and then adjusted to a pH of 6.0 with a 3.6 wt% hydrochloric acid aqueous solution. The temperature of the mixture was raised to 65° C., and the stirring was continued for additional 360 minutes. The resulting capsule solution was cooled to room temperature and adjusted to pH 9.0 with a 20 wt% aqueous solution of sodium hydroxide.

To the capsule solution were added 200 parts of a 10 wt% aqueous solution of polyvinyl alcohol and 50 parts of starch particles, and water was then added thereto to adjust the solid concentration to 20% to obtain a microcapsule coating composition containing a color former.

The coating composition was coated on a paper support having a basis weight of 50 g/m$^2$ to a thickness of 5 g/m$^2$ on a solid basis using an air knife coater, followed by drying to produce an upper paper of a pressure-sensitive recording material.

EXAMPLE 5

An upper paper of a pressure-sensitive recording material was obtained in the same manner as in Example 4 but using no 2(2'-hydroxy-5'-methylphenyl)-benzotriazole.

COMPARATIVE EXAMPLE 4

An upper paper of a pressure-sensitive recording material was obtained in the same manner as described in Example 4 except that 2(2'-hydroxy-5'-methylphenyl)benzotriazole and N-cyclohexyl-2-benzothiazolylsulfeneamide were not used.

The microcapsule-coated surface of each of the upper paper samples as above was irradiated with a high pressure mercury lamp for 2 minutes, and the color density was measured at a wavelength of 610 nm by means of a spectrophotometer manufactured by Hitachi, Ltd. Further, the coated surface was exposed to indoor light for 2 days, and the color density was measured in the same manner as above. The results obtained are shown in Table 2 below.

TABLE 2

| Example No. | Color Density Before Irradiation | Color Density After Irradiation*1 | Color Density After Exposure*2 |
|---|---|---|---|
| Example 4 | 0.05 | 0.08 | 0.06 |
| Example 5 | 0.05 | 0.12 | 0.08 |
| Comparative Example 4 | 0.05 | 0.18 | 0.10 |

Note:
*1irradiation with a high pressure mercury lamp
*2exposure to indoor light From the results shown in Table 2 above, it can be seen that the recording materials (Examples 4 and 5) according to the present invention hardly undergo the undesired coloration after irradiation as compared with the recording material including no the compounds of the present invention (Comparative Example 4).

While the invention has been described in detail and with reference to specific embodiments thereof, it will be apparent to one skilled in the art that various changes and modifications can be made therein without departing from the spirit and scope thereof.

What is claimed is:

1. A recording material comprising a support having provided thereon, microcapsules containing a basic leuco dye dissolved in an organic solvent, an ultraviolet absorbent present in an amount of from 0.01 to 10.0% by weight based on said organic solvent, and at least one 2-mercaptobenzothiazole.

2. A recording material as in claim 1, wherein the ultraviolet absorbent is present in an amount of from 0.2 to 5.0% by weight based on the organic solvent.

3. A recording material as in claim 1, wherein the compound N-cyclohexyl-2-benzothiazolylsulfeneamide.

4. A recording material as in claim 1, wherein the compound is present in a total amount of from 0.2 to 10% by weight based on the organic solvent.

5. A recording material as in claim 1, wherein the compound is present in a total amount of from 0.2 to 8% by weight based on the organic solvent.

6. A recording material as in claim 1, wherein the basic leuco dye is a triarylmethane type leuco dye or fluoran type leuco dye.

7. A recording material as in claim 1, wherein the basic leuco dye is a fluoran type leuco dye having an amino group or a substituted amino group at the 3- and 7-positions thereof.

8. A recording material as in claim 1, wherein the basic leuco dye is present in amount of from 5 to 20% by weight based on the organic solvent.

9. A recording material as in claim 1, wherein the recording material is a heat-sensitive recording sheet.

* * * * *